United States Patent [19]

Kaulfuss et al.

[11] 3,999,342

[45] Dec. 28, 1976

[54] STRUCTURE FOR EXHIBITION PURPOSES

[75] Inventors: William P. Kaulfuss, Wilmette; Robert H. Kaulfuss, Northbrook, both of Ill.

[73] Assignee: Container Corporation of America, Chicago, Ill.

[22] Filed: Apr. 11, 1975

[21] Appl. No.: 567,179

[52] U.S. Cl. ..... 52/239

[51] Int. Cl.[2] ..... E04B 2/74

[58] Field of Search ..... 52/239, 241, 63, 71, 52/238, 242

[56] References Cited

UNITED STATES PATENTS

| | | | |
|---|---|---|---|
| 2,097,697 | 11/1937 | Marks | 52/238 |
| 3,066,770 | 12/1962 | Millard | 52/239 X |
| 3,568,388 | 3/1973 | Lachbarth | 52/241 |

FOREIGN PATENTS OR APPLICATIONS

| | | | |
|---|---|---|---|
| 73,965 | 1/1954 | Netherlands | 52/245 |
| 488,970 | 7/1938 | United Kingdom | 52/245 |

*Primary Examiner*—John E. Murtagh
*Attorney, Agent, or Firm*—Carpenter & Ostis

[57] ABSTRACT

A readily erectable and dismantleable structure for exhibition purposes consists of a base element having upturned front and end flanges adapted to be secured to a base to define locating means for a yieldable thin-walled panel having the lower extremities of the central portion extending along and behind the upturned front flange and along and behind the end flanges, there being an identical cap element for the thin-walled panel, contiguous sections being joined at the end flanges of the base and cap elements.

3 Claims, 22 Drawing Figures

STRUCTURE FOR EXHIBITION PURPOSES

BACKGROUND OF THE INVENTION

The structure according to the present invention lends itself primarily to use in connection with exhibit space for conventions. The structure is composed of lightweight modular elements which can be arranged in a number of ways in accordance with the needs of an exhibitor who is charged by the convention management in proportion to the amount of exhibit space occupied.

The structure according to the present invention adapts itself to many configurations and may be U-shaped, serpentine, semi-circular or random in form when viewed in plan.

The panels of the modular elements are ordinarily made of corrugated paperboard or the like well adapted to the placement thereon of any desired graphics.

SUMMARY OF THE INVENTION

The principal object of this invention is to provide a readily erectable and dismantleable structure for exhibition purposes.

THE DRAWINGS

Figure 15:
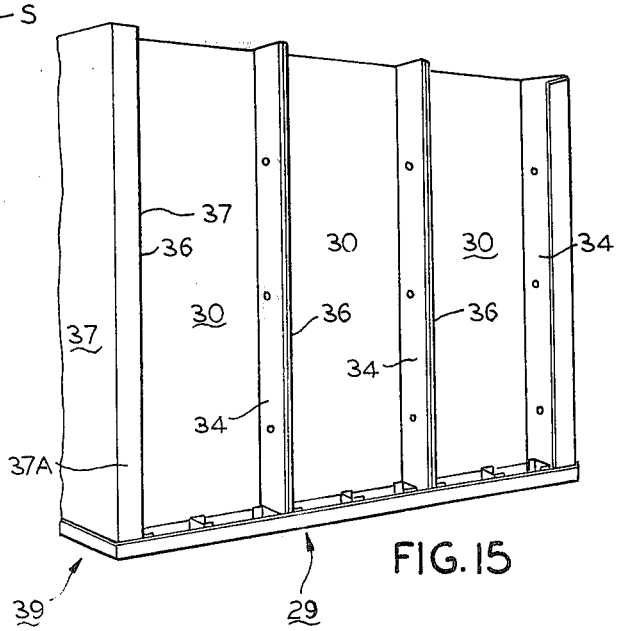
Figure 16:
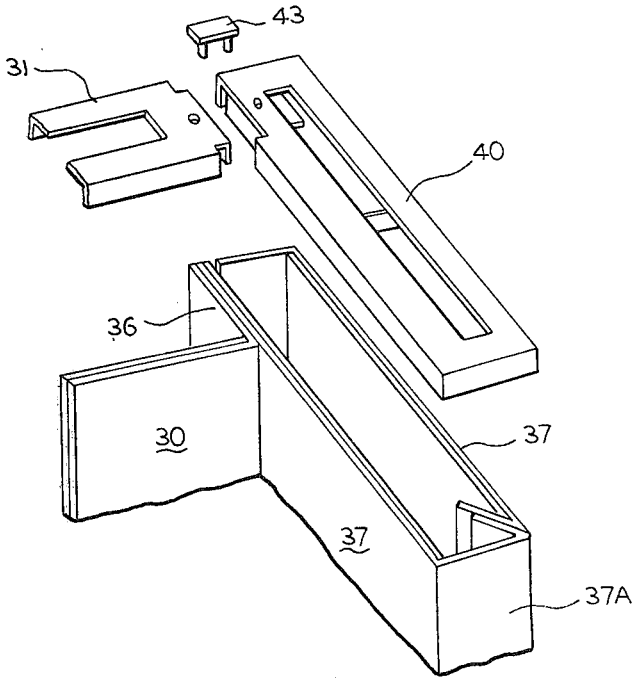
Figure 17:
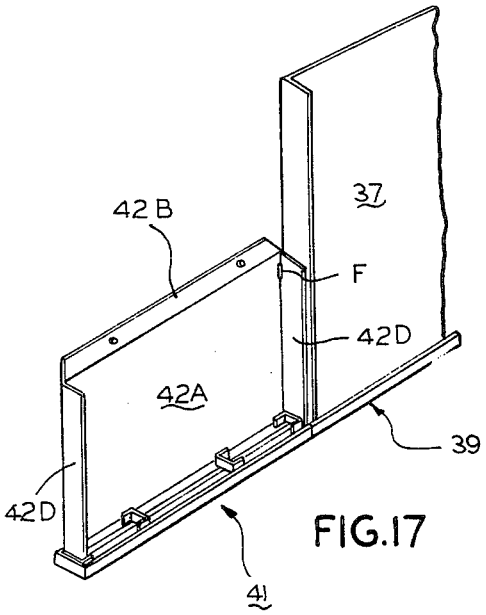
Figure 18:
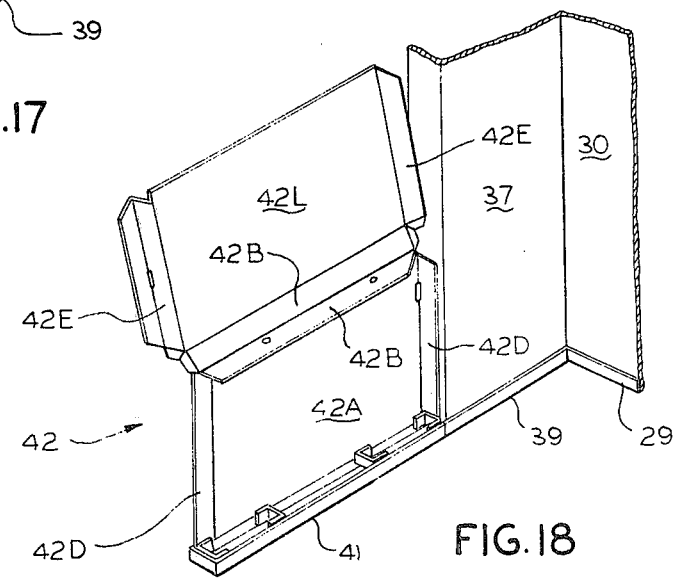
Figure 19:
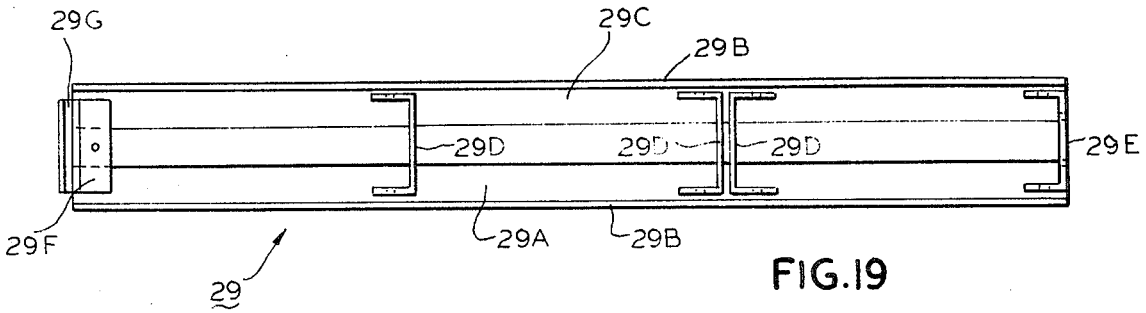
Figure 20:
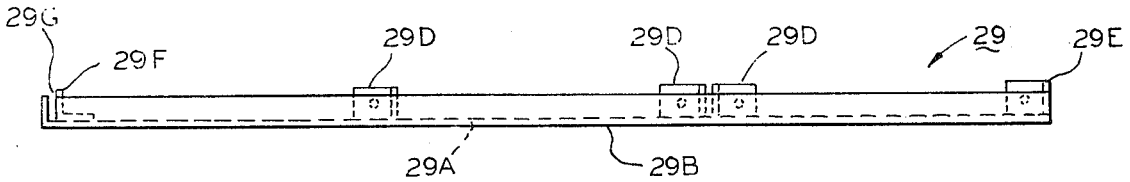
Figure 21:
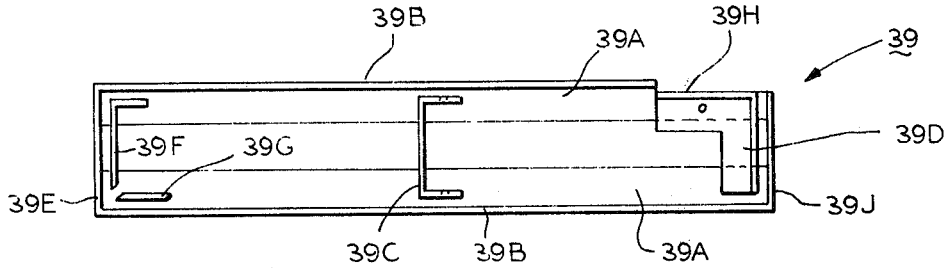
Figure 22:
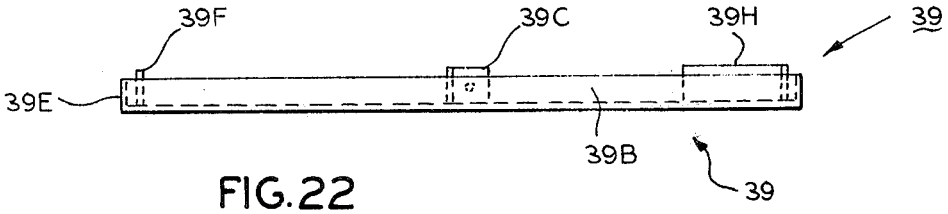

FIGS. 10 to 14 inclusive are perspective views showing steps in erecting the invention structure;

FIG. 15 is a perspective view showing the rear of the erected structure;

FIG. 16 is a perspective view showing details of connected cap elements;

FIGS. 17 and 18 are perspective views showing details of erecting a sub-modular rail structure;

FIGS. 19 and 20 are respective plan and elevational views of another form of base element; and FIGS. 21 and 22 are respective plan and elevational views of base elements for sub-modular end wall structures.

SPECIFICATION

Figure 1:
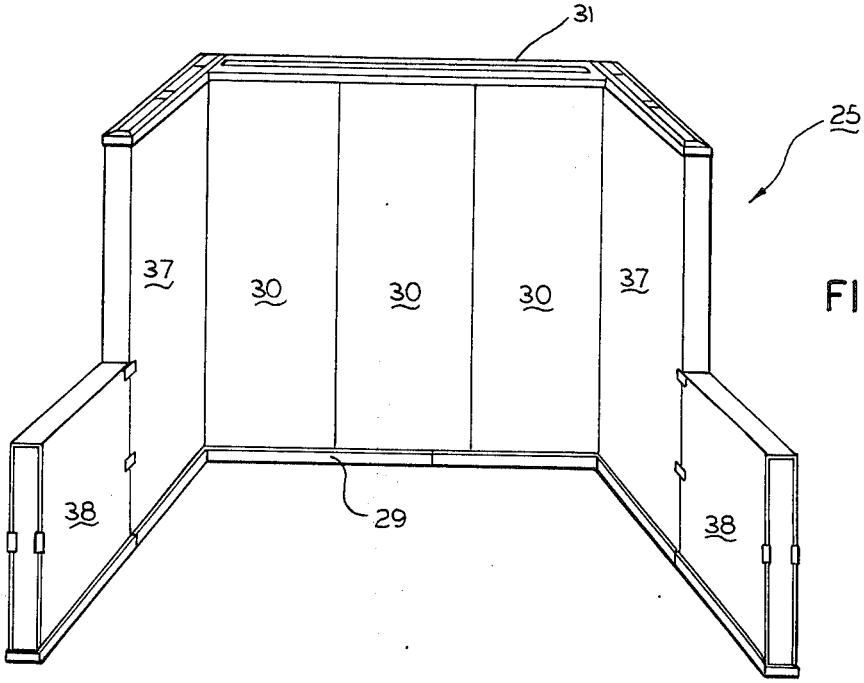
FIG. 1 is a perspective view of a structure according to the present invention.
Figure 2:
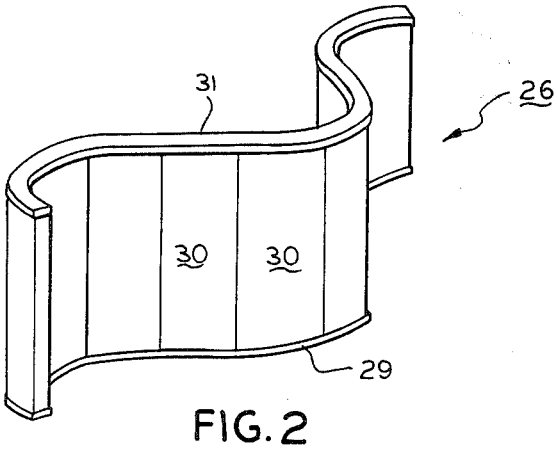
FIG. 2 is a perspective view of the structure arranged in serpentine fashion.
Figure 3:
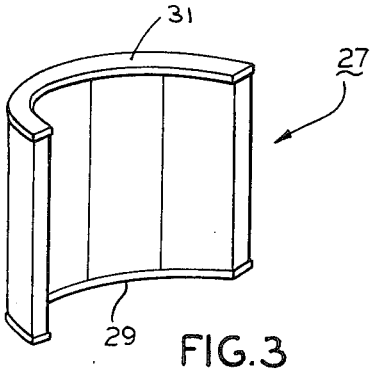
FIG. 3 is a perspective view showing a semi-circular structure.
Figure 4:
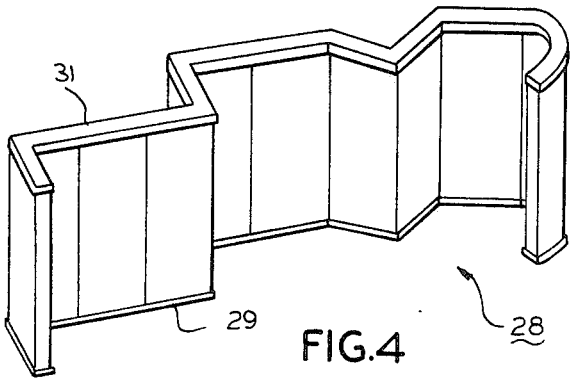
FIG. 4 shows a structure arranged in a random plan.

Referring now to FIGS. 1 to 4 of the drawings, the readily erectable and dismantleable structures according to the present invention are denoted generally by the reference numerals 25 to 28 inclusive; that of FIG. 1 being generally U-shaped in plan; that of FIG. 2 having a serpentine shape; that of FIG. 3 being semicircular in plan; and that of FIG. 4 being random in plan.

Figure 6:
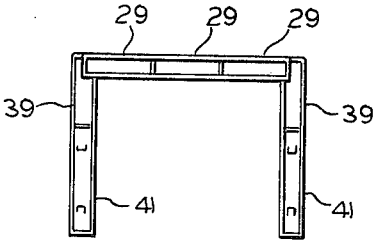
FIG. 6 is a plan view of connected base elements for the structure seen in FIG. 1.

Reference will be made particularly to the embodiment seen in FIGS. 1, 5 and 6 at this point which illustrates the invention structure most commonly used for exhibit booths at a convention, for example.

A base element 29 seen is adapted to be secured to a base surface in any convenient manner. Base element 29 is seen best in FIGS. 19 and 20, this form of base element being connected in end-to-end relationship, and being particularly indicated for the placement of a plurality of three thin-walled panels 30 extending in a common plane.

Each base element 29 is best seen with reference to FIGS. 19 and 20 and consists of laterally spaced angle members 29A and 29C, each angle member having upright flanges 29B. These are maintained in spaced relationship by spaced channel-shaped members 29D. One end of the angle members 29A and 29C is spanned by a similar channel-shaped member 29E, and the opposite end by a transverse member 29F having a deep groove 29G therein.

Figure 8:
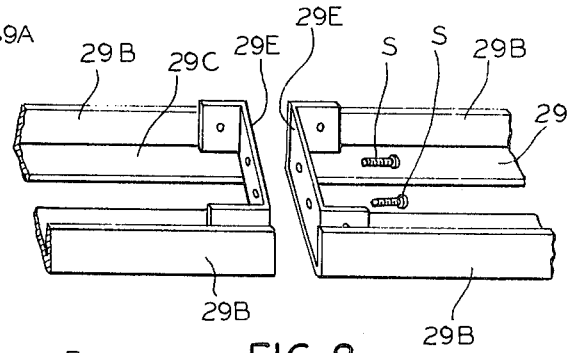

Each of the panel members 30 has an end panel portion 34, one of such end panel portions 34 being adapted to fit into the groove 29G, the other end panel portion 36 being adapted to fit between the webs of the closed spaced members 29D. The length of the base element 29 seen in FIG. 19 is equal to one and one-half times the width of a panel element 30, so that when channel elements 29E are connected as seen in FIG. 8 by screws S, a pair of base elements 29 will extend the width of three panels 30 occupying a common plane. A pair of such end panel portions 34 and 36 are thus able to fit between the closely spaced webs seen in FIGS. 19 and 20.

The lower extremities of each panel 30 are protected by the front upstanding flange 29B of base element 29. The upper portions of the panels 30 are likewise protected by a cap element 31 which is identical with the base elements 29, it having downturned front flanges 31B and flanges 31E and 31F, with a similar intermediate member 31D, cap elements 31 being identical to the base elements 29, and being shown in a general manner in FIG. 1.

Figure 5:
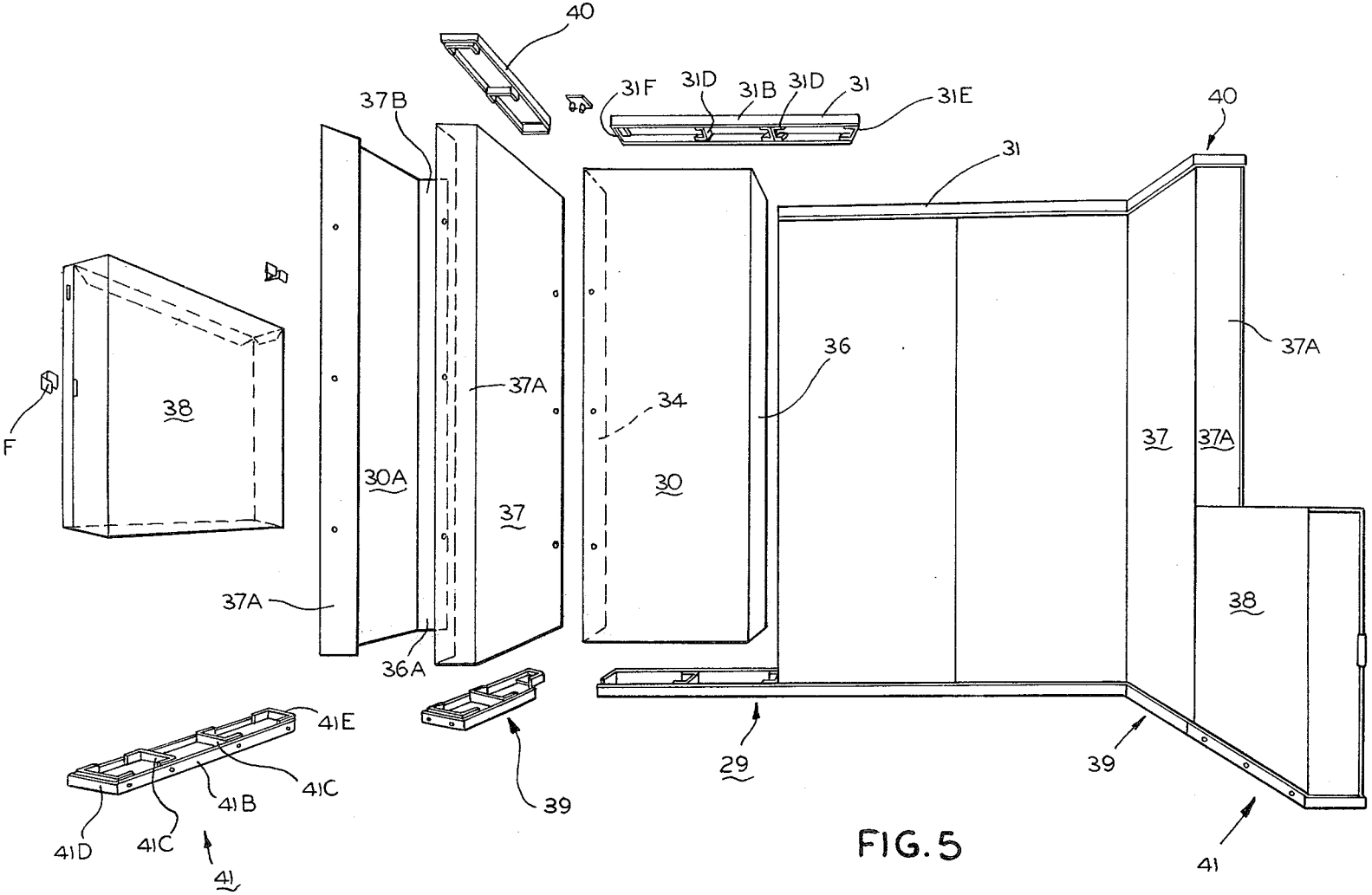
FIG. 5 is an exploded view of the structure seen in FIG. 1 showing the elements comprising the same.

In the embodiment seen particularly with respect to FIGS. 1 and 5, a space is enclosed which is substantially rectangular, the ends of the panels 30 described being flanked at each end by an end wall panel 37. The latter in turn are connected to end rails 38 of less height than the panels 30 and 37, so that exhibits within the total enclosure may readily be viewed by convention attendance, for example.

The panel 30 extending along the back wall has no backing elements, but both the end panels 37 and the rails 38 require both front and back panel elements for reasons of appearance.

Figure 7:
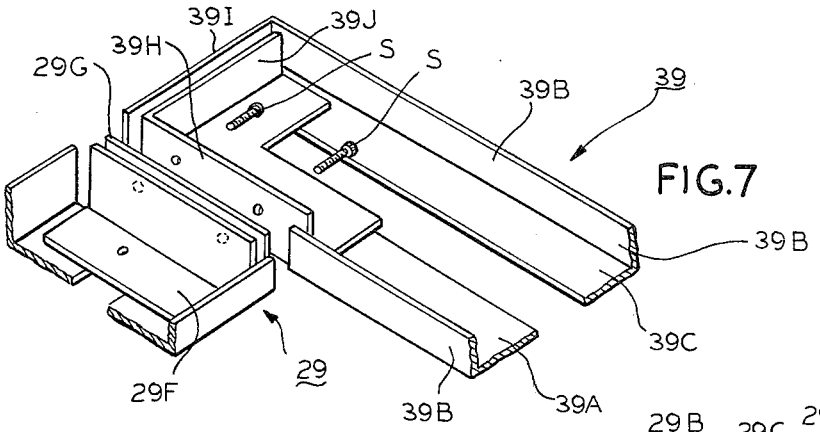
FIGS. 7, 8 and 9 are fragmentary isometric views of portions of a number of contiguous base elements and the mode of connecting same.

Accordingly, base elements 39 are provided, see also FIGS. 21 and 22, for locating the end panels 37, and each is arranged for the reception of a pair of such panels. The inner end panel 37 is thus adapted to be received along one of the base flanges 39B of base element 39, it being comprised of flanges 39A and 39B, the lower extremities thereof being protected thereby and the end panel portions 37A and 37B thereof being received along and behind laterally extending end flanges 39E and 39J of the base element 39. The opposite main panel 37 is received along the other upstanding flange 39B, and its end panel portions 37A and 37B are received along the end flanges 39E and 39J. The steps of erecting the end panels 37 are best seen with respect to FIGS. 10 and 11. One of the flanges 39 is discontinuous at one end thereof as seen also in FIG. 7, and an offset flange 39H is spaced inward thereof adjacent an end wall 39I, offset flange 39H having the inturned leg 39J providing with end wall 39I a groove for the reception of panel portion 37A therebetween.

The offset flange 39H provides for linking of an end of base element 29 at its end wall 29G, the flange 39H and end wall 29G being joined by screws S seen.

Figure 11:
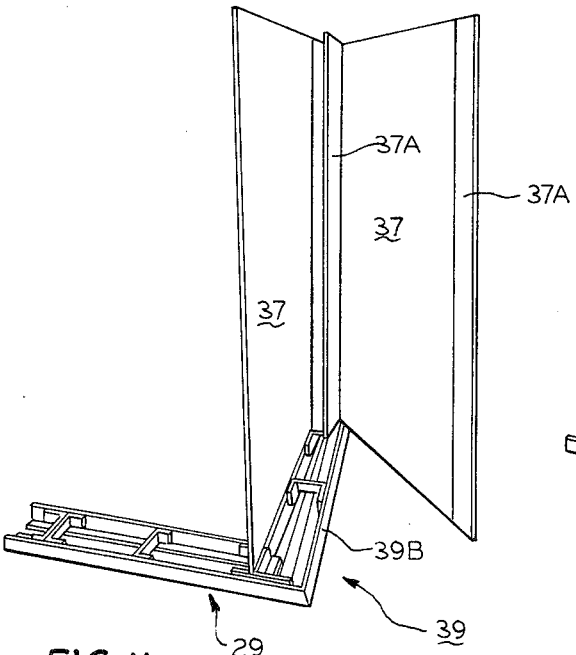
Figure 10:
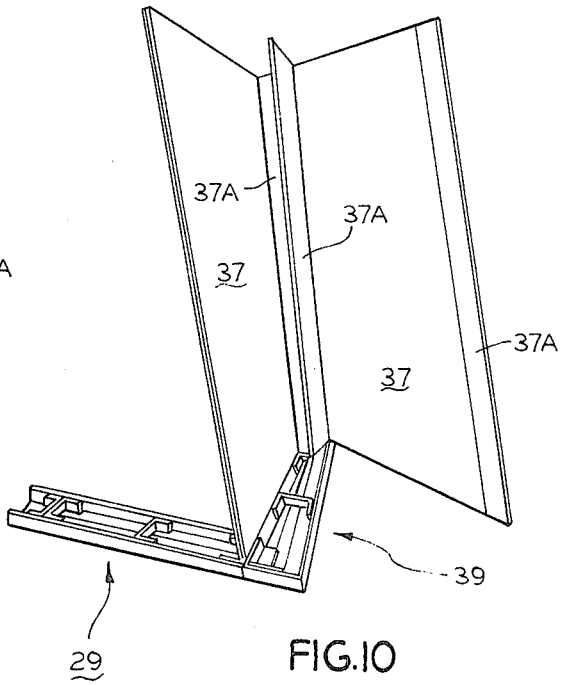
Figure 12:
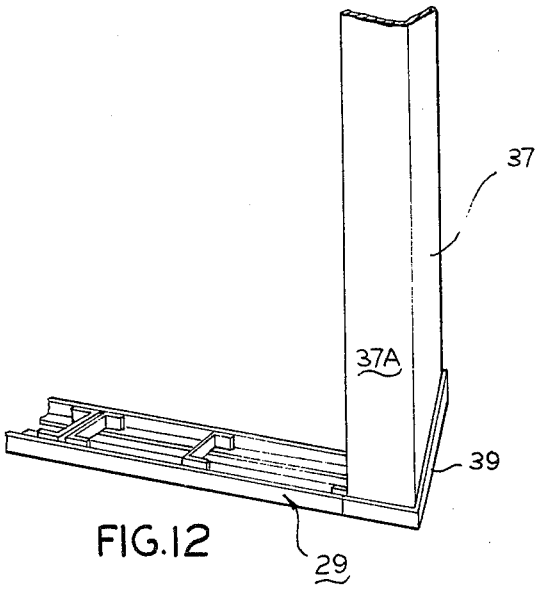
Figure 13:
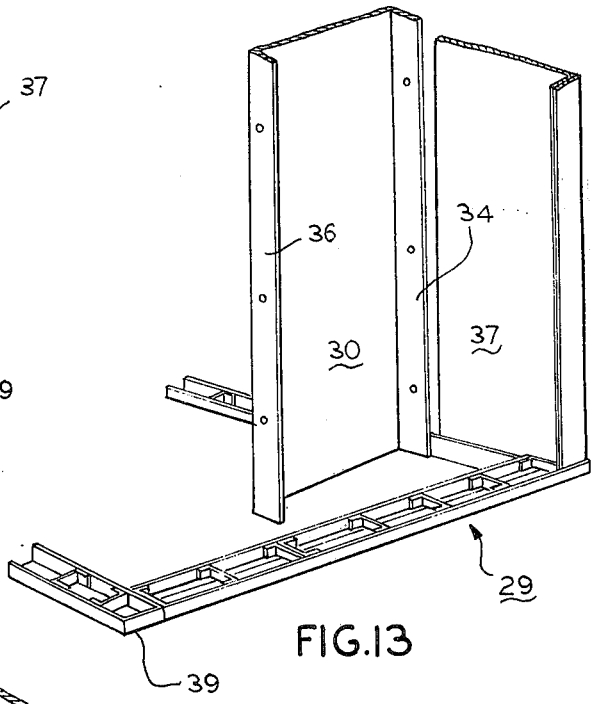
Figure 14:
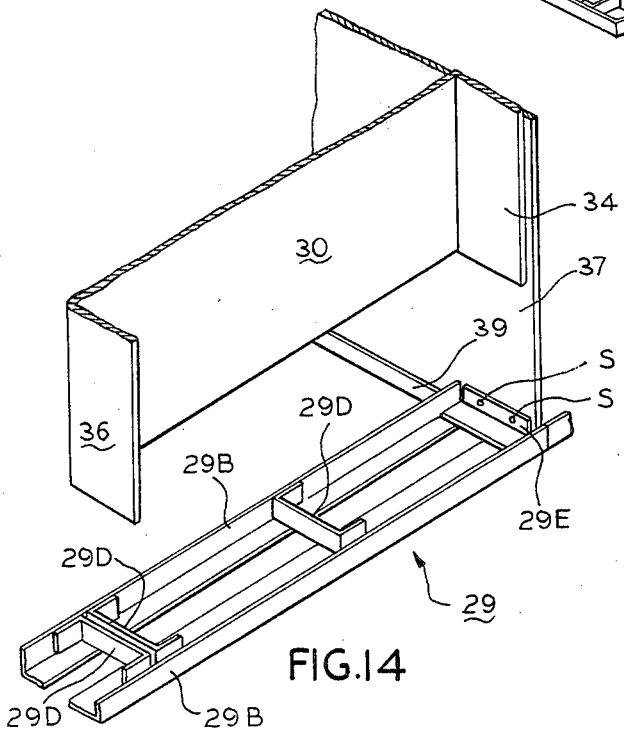

The panels 30 are already in position on their base members 29, and the walls 37 are placed in position on their bases 39. FIGS. 10 and 11 show the manner in which the end walls 37 are placed in position, and FIGS. 13 and 14 show the manner of placing panels 30 in position with reference to end wall 37. FIG. 15 shows the appearance of the back of the panels 30 and the end walls 37.

It should be noted that wall panels 30 are surmounted by the cap elements 31, and that end walls are surmounted by cap elements 40, identical respectively to the base elements 29 and 39. Cap elements 31 are like base elements 29, and cap element 40 is joined to cap element 31 as seen in FIG. 16 by a pinning device 43.

It should be borne in mind that the description obtaining at this point is related to the manner in which the right hand end panel 37 is joined to the right most back panel 30, and that structure for joining the left hand wing panel 37 to the end of the left hand back panel 30 is identical, but has an opposite hand. The elements comprising base element 39 seen in FIG. 6 are shown in the joining of base element 39 to base element 29 and screws S are shown for such joining.

Figure 9:
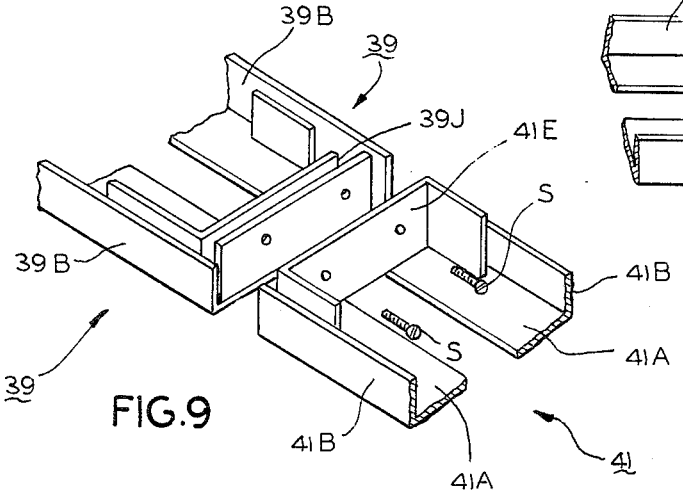

The end panels 37 are contiguous at one end to rails 38 permitting viewing of the enclosure within the back panels 30 and the end wall panels 37, the rails 38 additionally enclosing the space. Each of the rails 38 is mounted on a base element 41, one end of such base element being seen in FIG. 9, and being comprised of laterally spaced angle members 41A, each having upstanding flanges 41B. The angles 41A are maintained in spaced relationship by channel-shaped cross members 41C, see also FIG. 5, and end plate 41D is provided at one end of the base member 41, see also FIG. 5. The one end of the base member 41 has a vertically extending joining web 41E, see FIG. 9, and base member 41 is held to end wall 39J by the screws S shown. The assembly of the rail 38 is best seen with respect to FIGS. 17 and 18 which show it being joined to end walls 37, to afford a viewing of space contained within the panels 30 and 37.

The rail 38 in constructed of a cut and scored panel 42 of paperboard or the like consisting of a first side panel 42A, reinforcing panels 42B foldably connected to each other, one of said reinforcing panels 42B being foldably connected to an opposite side panel 42C.

Panel 42A lies alongside one of the flanges 41B and inward thereof, and panel 42C lies inward of the other flange 41B.

Panel 42A has opposite flaps 42D which lie against the end members 41D and 41E, and panel 42C likewise has opposed flaps 42E which are folded to position against flaps 42D to complete a boxlike structure. The folds of reinforcing panels 42B lend additional stiffness to the rails 38. Suitable fastening elements F may be employed to maintain the structural integrity of rails 38.

I claim:

1. In a readily erectable and dismantleable structure for exhibition purposes:

a. a base element having upturned front and end flanges;

b. said base element being detachable secured to a fixed base;

c. a yieldable thin-walled panel supported by said base element and having a central panel portion and end panel portions extending from said central portion;

d. said panel having its central panel portion extending along and behind said upturned front flange and having the lower extremities thereof protected thereby;

e. said end panel portions extending along said end flanges and being held thereagainst;

f. elements spaced along said base and at the ends thereof and spaced from said front and end flanges and cooperating with said front and end flanges to receive said central portions of said panel and end portions thereof;

g. a cap element identical to said base element and having downturned front and end flanges;

i. said downturned front flange extending over upper extremities of said central panel portion;

ii. said downturned end flanges extending along the end panel portions;

iii. said downturned front and end flanges being provided with elements spaced therefrom and cooperating with said front and end flanges to receive central and end portions of said panel;

h. means securing base elements together;

i. means securing cap elements together;

j. said base and cap elements extending along predetermined geometric patterns to provide a structure of like geometric configuration in plan view.

2. A structure according to claim 1 wherein said thin-walled panel consists of central panel portions extending in a common plane, and said base and cap elements are comprised of laterally extending members constraining said central panel portions against the flanges of said base and cap elements.

3. A structure according to claim 1 wherein said thin-walled panel is flanked by end walls having panel portions held in position by additional base and cap elements joined to the first named base and cap elements.

* * * * *